US006031183A

United States Patent [19]

Guerrieri

[11] Patent Number: 6,031,183

[45] Date of Patent: Feb. 29, 2000

[54] ELECTRICAL OUTLET COVER, CORD AND PLUG COMBINATION

[76] Inventor: Richard P. Guerrieri, 105 A. Harvest Moon Ct., Jupitor, Fla. 33458

[21] Appl. No.: 08/922,014

[22] Filed: Sep. 2, 1997

[51] Int. Cl.[7] ..... H01R 13/44

[52] U.S. Cl. ..... 174/67; 220/241; 220/242

[58] Field of Search ..... 439/954, 540.1; 174/66, 67; 220/241, 242, 3.8

[56] References Cited

U.S. PATENT DOCUMENTS

| | | | |
|---|---|---|---|
| 2,516,464 | 7/1950 | Hooser | 174/67 |
| 4,451,101 | 5/1984 | Davis | 439/194 |
| 4,914,265 | 4/1990 | Mongean | 200/330 |
| 4,993,963 | 2/1991 | Pedigo | 439/142 |
| 5,067,907 | 11/1991 | Shotey | 439/135 |
| 5,078,614 | 1/1992 | Shotey | 439/136 |
| 5,096,432 | 3/1992 | Cullen et al. | 439/139 |
| 5,218,169 | 6/1993 | Riceman | 174/67 |
| 5,653,135 | 8/1997 | Miller et al. | 70/303 A |

*Primary Examiner*—Kristine Kincaid
*Assistant Examiner*—Dhiru R Patel
*Attorney, Agent, or Firm*—Renner, Kenner, Greive, Bobak, Taylor & Weber

[57] ABSTRACT

An electrical outlet cover, cord, and plug combination includes a wall plate covering a wall outlet and receiving a cover thereover to preclude access by children. In one embodiment of the invention, the cover is slidably received on the base plate, while another embodiment teaches the cover being hingedly secured thereto. Electrical plugs for receipt by the outlet have the cord extending radially therefrom with respect to the prongs of the plugs. The cord extends at an oblique angle with respect to a line interconnecting the plugs such that the plugs and cords present a flat attitude at the outlet. Standard plug and cord assemblies may achieve the attitude by implementation of an adaptor. The electrical plugs according to the invention provide receptacles such that the male and female interconnecting portions interlock within a substantially circular wall to retard disengagement. A shim washer, having tapered cross section, is provided to assure that the wall plate and wall properly align. A cam lock assembly is provided on a slidable cover for a wall plate to assure that the wall plate and associated outlet remains covered until the cam lock is properly manipulated to allow access to the outlet.

7 Claims, 8 Drawing Sheets

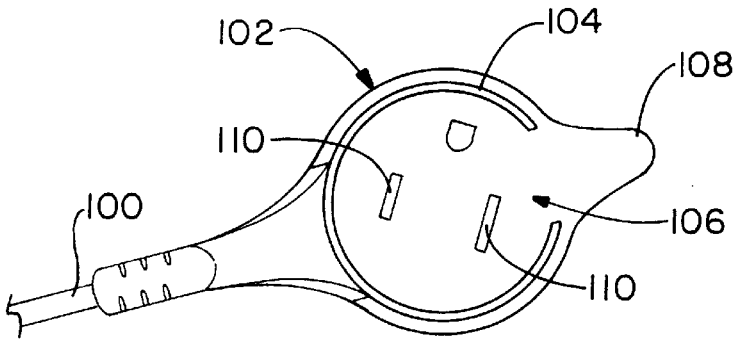
FIG.-14
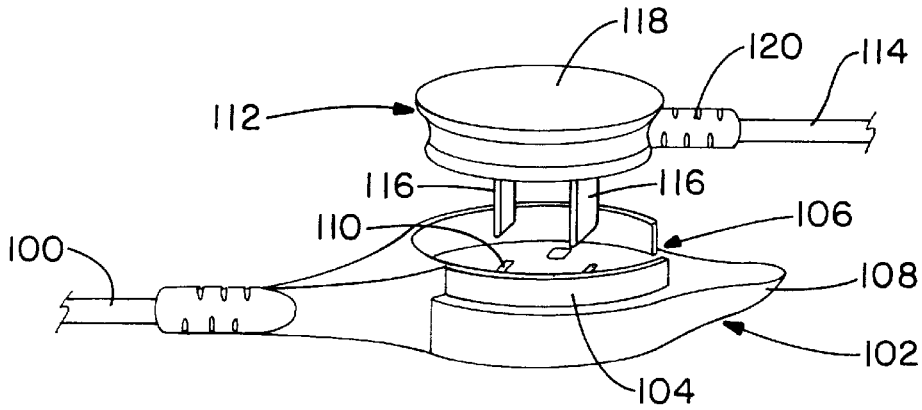
FIG.-15
FIG.-16
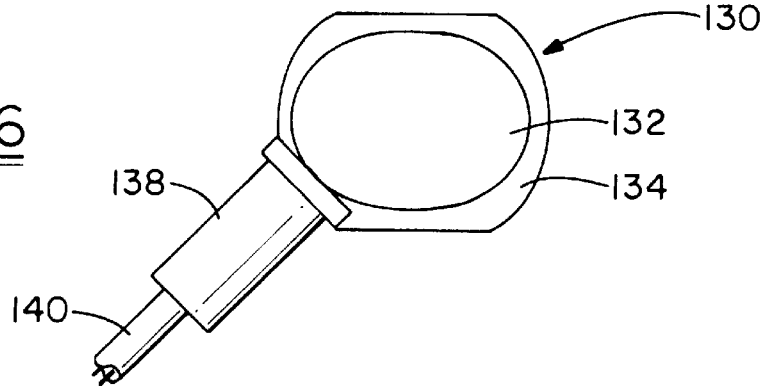
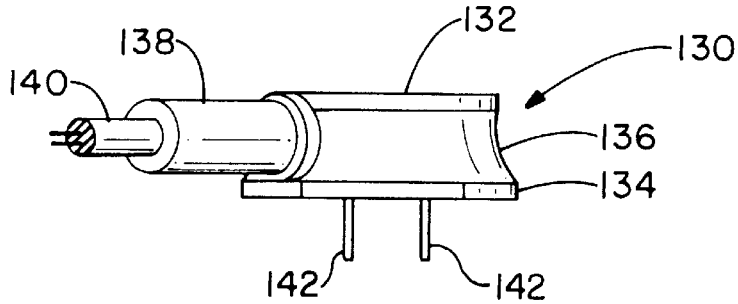
FIG.-17

ELECTRICAL OUTLET COVER, CORD AND PLUG COMBINATION

TECHNICAL FIELD

The invention herein resides in the art of electrical connector devices. More particularly, the invention relates to an electrical outlet cover, cord and plug combination. Specifically, the invention presents an electrical plug of a relatively flat construction, and in which the cord leaves the plug at an oblique angle. A cover is slidingly received over the electrical outlet receiving the plug to conceal the interconnection of the two. The invention further teaches the implementation of a ground clip, as needed, and a shim for aligning a wall plate with a wall. Moreover, the invention is adapted to implementation for developing an extension cord having interlocking engagement between the plug and receptacle ends.

BACKGROUND OF THE INVENTION

Typically, electrical service is provided by means of wall outlets. Electrical plugs, having cords extending therefrom, are interconnected with the electrical wall outlets to conduct electrical power from the outlet to a connected device. Most typically, the cord extends on an in-line fashion from the plug and is aligned therewith. Accordingly, the cord and plug extend several inches from the wall outlet before the cord curves to a parallel posture with respect to the wall. As a consequence, furniture or other items positioned adjacent the wall must be spaced sufficiently therefrom to accommodate the plug and cord interconnection with the wall outlet.

Moreover, presently known wall outlet and plug combinations are generally unattractive and pose somewhat of a safety factor in that they are exposed to children or easily accessed by children.

In the prior art, the implementation of ground clips with two prong plug outlets has generally been a difficult task. In general, the implementation of a ground line pigtail has required removal and replacement of the securing screw holding the outlet cover plate to the outlet. There has been no known means for easily interconnecting a ground clip from a plug to the wall socket.

In the prior art, it has also been known that extension cords are typically not interlocking, apart from the engagement between the prongs of the male plug and the female receptacle. The same structure that provides the electrical interconnection also is responsible for attaining the mechanical securing engagement of the elements. There is no known simplistic and effective means for achieving interconnection of the extension cord ends.

Additionally, the prior art has generally been fraught with outlet boxes which are not flush or parallel to the walls in which they are received. Accordingly, when cover plates are placed thereover, the plates do not seal against the wall.

There is presently a need in the art for an electrical outlet cover, cord and plug combination which overcomes the shortcomings presented above.

SUMMARY OF INVENTION

In light of the foregoing, it is a first aspect of the invention to present an electrical outlet cover which is adaptable for concealing a wall outlet with interconnected plugs, and to do so in a decorative manner.

Another aspect of the invention is the provision of an electrical outlet cover which precludes ease of access to the plug and outlet assembly.

A further aspect of the invention is the provision of an electrical outlet cover and plug combination which minimizes the extension of the plug from the wall when the plug is received in the outlet.

Yet another aspect of the invention is the provision of a shim washer which may be interposed between an electrical outlet and wall cover to cause the cover to seal against the wall, even where the electrical box and wall are not parallel or flush.

Still a further aspect of the invention is the provision of an electrical outlet cover, cord and plug combination which provides the inclusion of a ground clip wire in a simple and cost effective manner.

Yet an additional aspect of the invention is the provision of an electrical cord and plug combination which is given to adaptation to extension cords, having secure interconnections.

The foregoing and other aspects of the invention which will become apparent as the detailed description proceeds are achieved by an outlet cover assembly, comprising: a base plate receiving and maintaining an outlet; and a cover plate received by said base plate, said cover plate selectively covering and exposing said base plate.

Additional objects which will become apparent herein are attained by an electrical cord assembly, comprising: an electrical cord; and a plug at one end of said cord, said plug having male prongs extending therefrom, said prongs being in a line, said cord engaging said plug at an angle oblique to said line.

Other aspects of the invention are attained by a shim washer for accommodating misalignment among a wall outlet, a cover plate for the outlet, and a wall, comprising: a piece of material having tapered thickness and an aperture passing centrally therethrough.

Yet other aspects of the invention are achieved by a ground clip for an electrical outlet, comprising: an elongated body member having an aperture at a first end thereof for securement to an outlet; a tab extending from said body member for engagement behind a cover plate; and a post threadedly engaged at a second end of said body member.

BRIEF DESCRIPTION OF THE DRAWINGS

For a complete understanding of the objects, techniques, and structure of the invention reference should be made to the following detailed description and accompanying drawings wherein:

FIG. 14 is the female end of an electrical cord made in accordance with the invention;

FIG. 15 is an illustrative view of the male and female ends of cords made in accordance with the instant invention;

FIG. 16 is a top plan view of a plug assembly according to another embodiment of the invention;

FIG. 17 is a side elevational view of the plug assembly shown in FIG. 16;

BEST MODE FOR CARRYING OUT THE INVENTION

Figure 1:
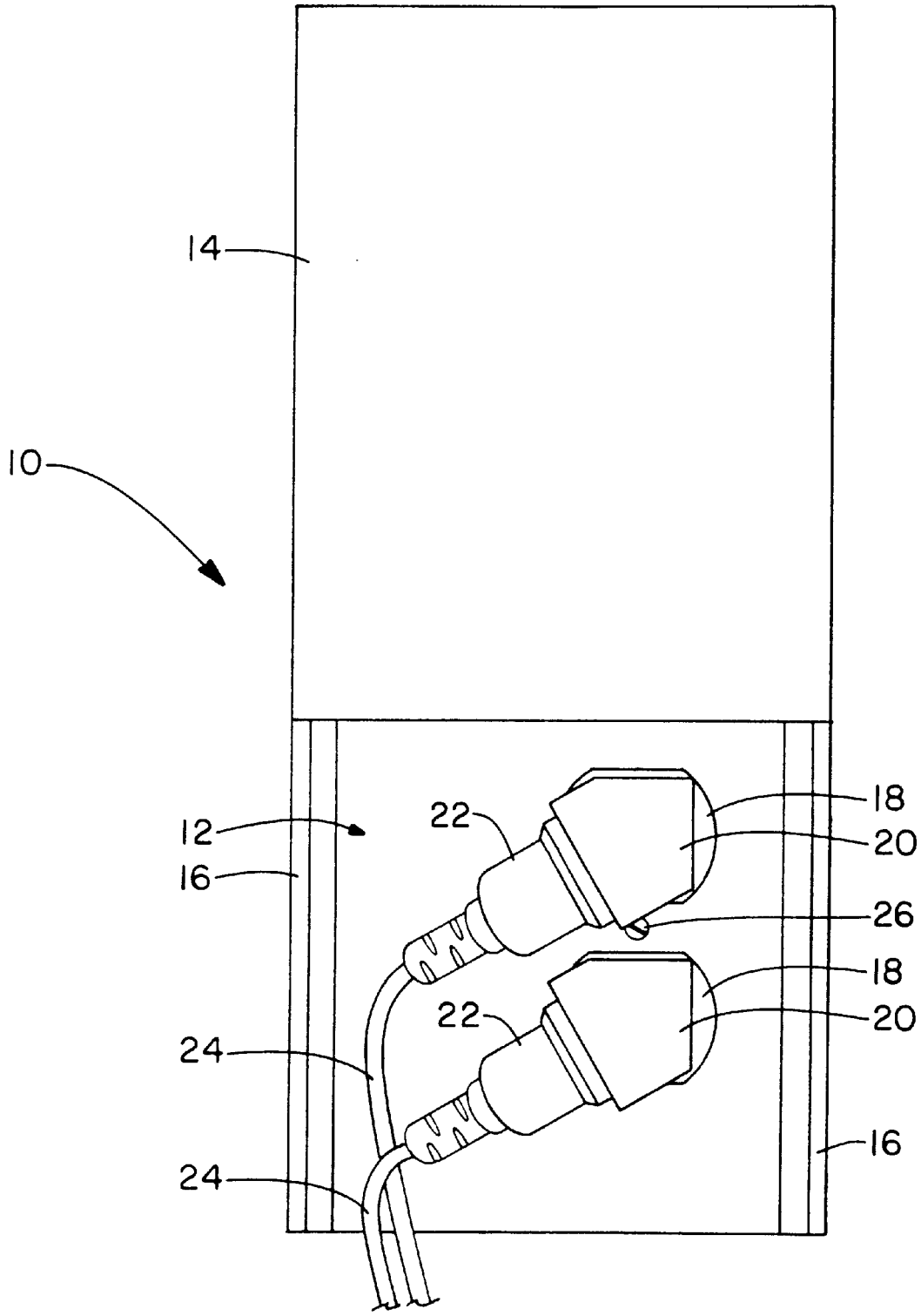
FIG. 1 is a front elevational view of an electrical outlet cover, cord and plug combination in accordance with the invention, the cover being in an open position.

Referring now to the drawings and more particularly to FIG. 1, it can be seen that a plug and cover assembly made in accordance with the invention is designated generally by the numeral 10. The assembly 10 includes a base plate 12 slidingly receiving a cover sleeve 14 thereover. The cover sleeve 14 is received by tracks or ways 16 positioned along opposite sides of the base plate 12. A wall socket or electrical outlet 18, has the sockets thereof exposed through apertures of the base plate 12, as shown. Angled plug adapters 20 are received by the wall socket 18 and are angled such that conventional plugs 22 which are received therein extend obliquely therefrom such that the cords 24 thereof extend downward along the side of the base plate 12. As illustrated, a screw 26 holds the base plate 12 to the wall socket or electrical outlet 18.

Figure 2:
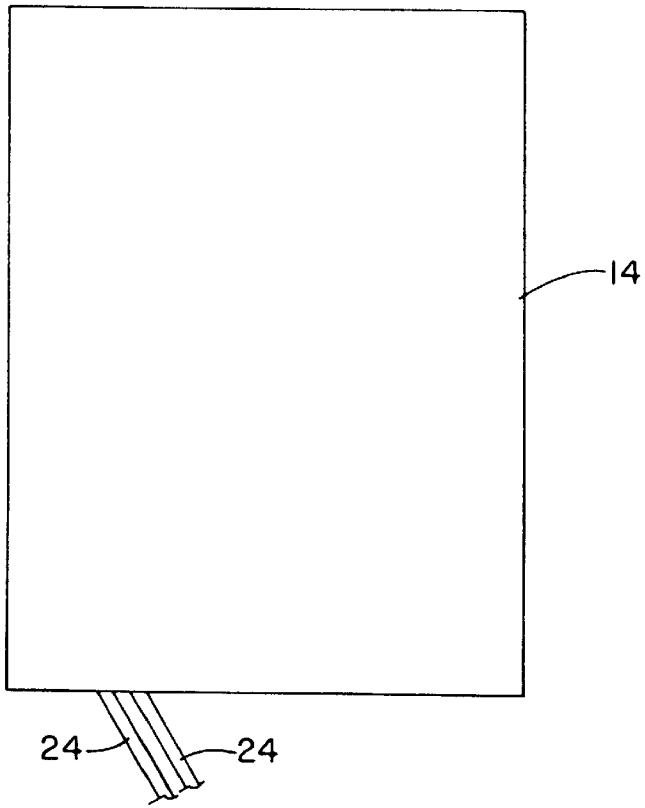
FIG. 2 is a front elevational view of the structure of FIG. 1, with the cover in a closed position.

It will be appreciated that FIG. 1 illustrates the plug and cover assembly 10 in a position in which the cover sleeve 14 has been raised along the tracks or ways 16 to expose the outlet 18 and associated plug and cord assemblies. In FIG. 2, the same assembly is shown with cover sleeve 14 slid downwardly to close or conceal the outlet and plug assemblies, such that only the cords 24 extending therefrom can be seen.

Figure 4:
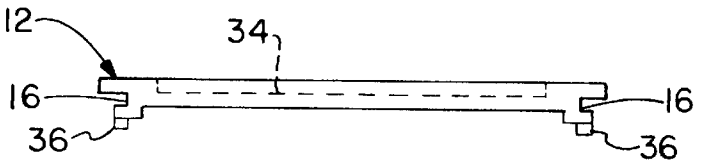
FIG. 4 is a top plan view of the base plate of FIG. 3.
Figure 3:
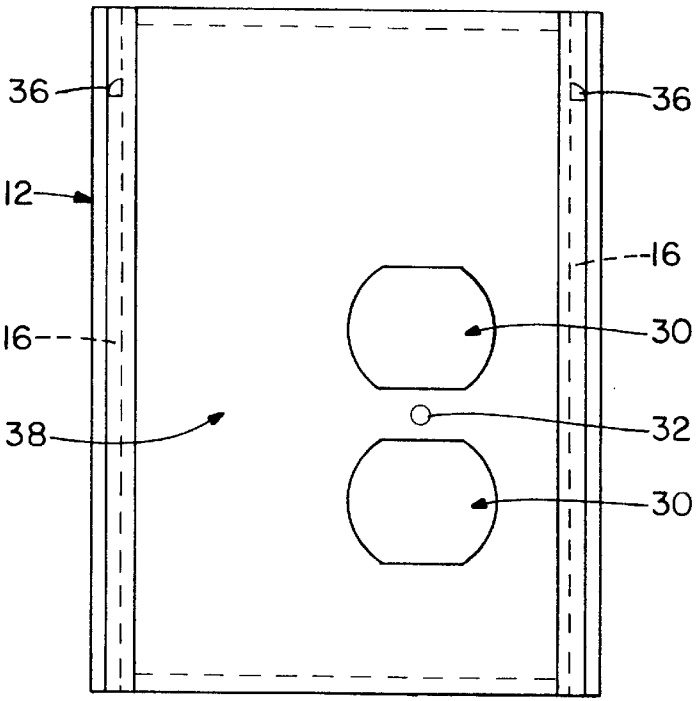
FIG. 3 is a front elevational view of the base employed in the assembly of FIGS. 1 and 2.

The base plate 12 is illustrated in FIGS. 3 and 4, where it can be seen that apertures 30 are provided therein to receive a wall socket 18, while an aperture 32 is provided for receiving passage of the screw 26. The back of the base plate 12 is recessed as at 34.

It will be appreciated from FIGS. 3 and 4 that the tracks 16 along each side of the base plate 12 are in the form of generally U-shaped channels, having generally longer back legs than front legs—as best seen in FIG. 4. Extending from the front legs of the tracks 16 near the top end thereof are a pair of stops 36, one positioned on each such front leg. It will be appreciated that apertures 30 for receiving the electrical outlet 18 are offset to one side of the base plate 12, allowing for an area 38 along the opposite side thereof to receive the cords 24, as will be appreciated by the reference again to FIG. 1.

Figure 5:
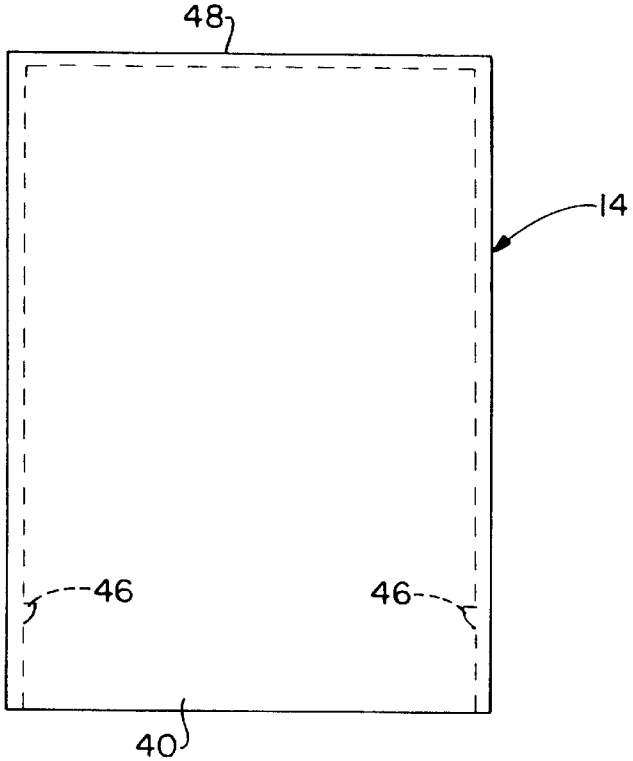
FIG. 5 is a front elevational view of the cover sleeve employed in the assembly of FIG. 1.
Figure 6:
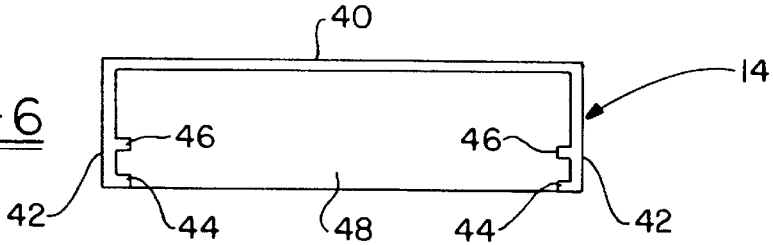
FIG. 6 is a bottom plan view of the cover sleeve of FIG. 5.

With attention now to FIGS. 5 and 6, it can be seen that cover sleeve 14 includes a front plate 40 interconnected with side plates 42 extending normally therefrom. Flanges 44 extend from opposite ends of the side plates 42 inwardly toward the open back portion of cover sleeve 14. The flanges 44 are adapted for receipt in the channels formed between the legs of the tracks 16 of the base plate 12. A pair of stops 46, one on the interior surface of each of the legs 42 near the bottom thereof, are positioned, as illustrated. The stops 46 are adapted to engage with corresponding stops 36 on base plate 12 to limit the opening motion or movement of the cover sleeve 14 upon the base plate 12 and to restrict removal thereof.

It will be appreciated that the cover sleeve 14 is open at the back and bottom thereof and closed by a top plate 48 at the top end thereof. When the cover sleeve 14 is in its closed position, the top plate 48 engages a top edge of the base plate 12 such that the cover sleeve 14 is supportingly maintained thereon. The bottom portion is open to receive and pass the cords 24, again as shown in FIGS. 1 and 2.

Figure 7:
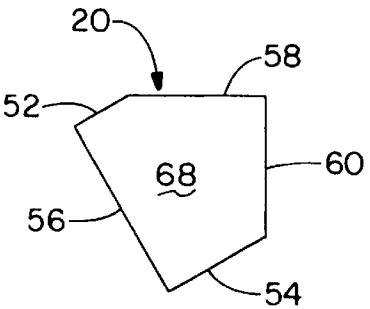
FIG. 7 is a top plan view of a plug adapter made in accordance with the invention.
Figure 8:
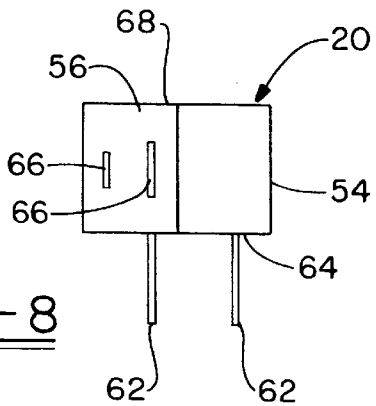
FIG. 8 is a front elevational view of the plug adapter of FIG. 7.

It will be appreciated that most electrical plugs have a cord extending therefrom which has prongs which are parallel to and/or in line with the cord itself. As a consequence, when plugs are positioned in electrical outlets, the cords extend perpendicularly from the wall and have a tendency to overlap each other. Such an arrangement aggravates the clearance which must be allowed to a wall socket for furniture or the like which is to be positioned against the wall. Moreover, such an arrangement is typically unsightly. Accordingly, the instant invention contemplates either the redesign of the cord plug itself, or the implementation of an adapter such that the conventional plugs may engage in a manner substantially parallel to the wall such that the cords are always parallel to the wall. Angled plug adapters 20 capable of achieving such an arrangement are shown in FIGS. 7 and 8. As illustrated, angled plug adapters 20 of the invention have a general pentagonal shape of unequal sides. A pair of unequal parallel sides 52, 54 extend normally from an end 56. Sides 58, 60 are generally orthogonal to each other and interconnect with the ends of the sides 52, 54 opposite the end 56. Extending downwardly from the bottom plate 64 are plug prongs 62 which engage with and are in electrical communication with the slots 66 provided in the end wall 56. The slots 66 are adapted to receive a conventional plug 22. It will, of course, be appreciated that a third hole or slot might be included for grounding purposes.

The plug adaptor 20 also has a top plate 68 which is preferably parallel to the bottom plate 64, with the sides 52–60 interconnected therebetween. The sides 52–60 may be recessed within the envelop defined by the top and bottom plates 64, 68, or may be flush with them, as shown.

It will be appreciated that the angled plug adapters 20 serve several purposes. First, they achieve a right angle bend from the prongs 62 to the receiving slots 66, such that a plug at the end of a cord may be inserted therein with the cord being substantially parallel to the wall. Moreover, with the end wall 56 being oblique to the prongs 62, the plugs 22 and associated cords 24 extend at an angle from the wall socket 18 and parallel to the wall as best shown in FIG. 1. As a result, the maximum extension of electrical connection from the wall is dictated by height of the body of the angled plug adapters 20. That height is significantly less than that of a typical plug 22.

Figure 9:
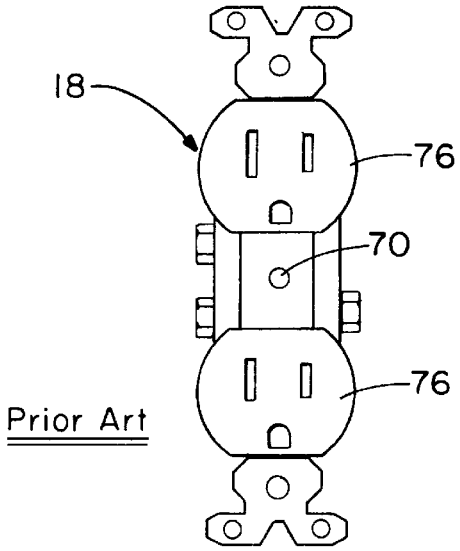
FIG. 9 is a front elevational view of a typical wall socket or electrical outlet.
Figure 10:
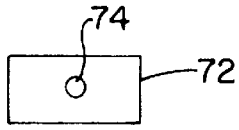
FIG. 10 is a top plan view of a shim washer according to the invention.
Figure 11:
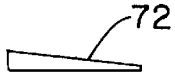
FIG. 11 is a side elevational view of the shim washer of FIG. 10.

It is well know that electrical outlet boxes which are typically secured to wall studs are often not flush with or parallel to the wall surface. Accordingly, when the wall socket 18 (as shown in FIG. 9) is positioned into the electrical box, and a cover plate positioned thereover, the cover plate is often canted or skewed with the respect to the wall. In other words, the cover plate does not seal against the wall because the plug 18 and the electrical box in which it is received are not parallel to the wall. This situation is corrected by implementation of a shim washer 72, such as shown in FIGS. 10 and 11. The shim washer 72 has an aperture 74 therein for alignment with the threaded aperture 70 of wall socket 18. As shown in FIG. 10, the shim washer 72 is typically of rectangular shape and is dimensioned to be interposed between the jacks 76 of the outlet 18. As illustrated in FIG. 11, the shim washer 72 tapers from one side to the other. The shim washer is, of course, reversible such that the taper may extend in either direction. In a preferred embodiment of the invention, the maximum thickness at one end of the shim washer 72 is ⅛ inch, and the minimum thickness at the opposite side is 1/32 inch. It has been found that a washer of such dimension and thickness is suitable for correcting for the disparities and typically encountered between the electrical box and wall surface. In other words, the shim washer 72 is sufficient to accommodate and/or correct for most anomalies which are encountered.

Those skilled in the art will appreciate that multiple shim washers could be employed in a stacked arrangement, where desired.

There is often a need for a ground clip or ground tap for use in association with an electrical outlet. Some plugs do not employ a three prong arrangement, in which one of the prongs is grounded. Instead, a ground wire or pigtail is employed and is intended for engagement with a grounding screw on the wall outlet. Often this arrangement requires the removal of the screw holding the cover plate to the wall outlet, the attachment of the ground pigtail, and the replacement of the screw. It has been found that such an arrangement can be simplified, either in combination with the use of plug and cover assembly 10 of the instant invention, or otherwise.

Figure 12:
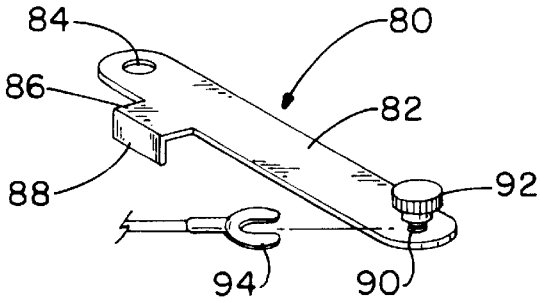
FIG. 12 is a perspective view of a ground clip according to the invention.
Figure 13:
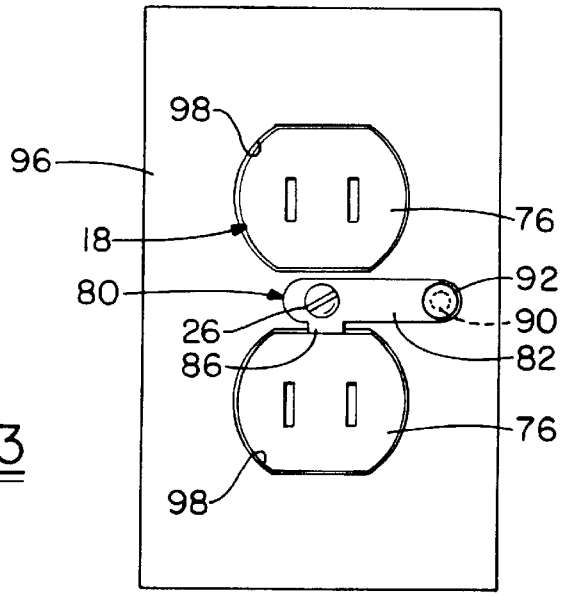
FIG. 13 is a front elevational view of a wall socket and cover plate employing the ground clip of FIG. 12.

As shown in FIG. 12, a ground clip according to the invention is designated generally by the numeral 80. Ground clip 80 has an elongated body member 82 which can be of any suitable shape. While the ground clip 80 is shown to be somewhat triangular in shape, it could be rectangular, as well. One end of body member 82 is provided with an aperture 84 which will ultimately receive the cover screw 26. A leg 86 extends downwardly from body member 82 and has a tab 88 extending normally therefrom. At the opposite end of the body member 80, a post 90 extends therefrom. A head 92 characterizes the end of the post 20 opposite the body member 82. As shown in FIG. 13, the ground clip 80 is secured to the grounded body portion of an electrical outlet 18 by means of the screw 26 passing through the aperture 84 and into the outlet 18. The same screw 26 maintains the cover plate 86 in its desired position. The tab 88 extends along side one of the jacks of the outlet 18, as illustrated. The tab 88 precludes the ground clip 80 from rotating about the screw 26, holding the ground clip 80 in a secure position. A plug received in the outlet 18 and having a ground wire 94 extending therefrom can thereby be grounded by slipping the connector of the ground wire 94 over the post 90 where frictional or spring-like engagement is achieved. The head 92 prevents ground wire 94 from slipping off of the top end of post 90.

It will be appreciated that the ground clip 80 is reversible, such that it may extend to the left, rather than the right of the plug as shown in FIG. 13. In such a position, the tab 88 will be received in the aperture of the upper jack of the plug 18, rather than the lower one, as illustrated.

As mentioned earlier, the off-set nature of the plug and socket engagement achieved by implementation of the angled plug adapters 20 can be attained by appropriate design and configuration of receptacles at the ends of the cords 24. In this regard, reference is now made to FIGS. 14 and 15 wherein it can be seen that an electrical cord 100 is provided with a female receptacle 102 at an end thereof. The female receptacle 102 is characterized by an upwardly extending wall 104 which has an open end. As seen in FIGS. 14 and 15, the wall 104 encompasses approximately 300°–330°, defining an open ended cavity 106. Extending from the open ended cavity and from the opening in the upwardly extending wall 104, is a tongue 108. The female slots 110 are provided in the receptacle 102 and within the cavity 106. Two or three slots may be employed, depending upon whether a ground wire is incorporated. In any event, the two elongated parallel slots of the slots 110 are oblique or angled with respect to the line of the cord 100 and the tongue 108. The angle is typically on the order 30°–60°.

As shown in FIG. 15, a male plug 112 is configured to mate with the female receptacle 102 in interlocking fashion. The male plug 112 has a cord 114 extending therefrom and a pair of prongs 116 extending downwardly from a bottom surface thereof. The prongs 116 are oblique to the cord 114 as they extend from the body portion 118. The angling of the parallel prongs 116 with respect to the cord 114 is similar to the angling of the parallel slots 110 with respect to the cord 100.

It will be appreciated that a collar 120, which is interposed between the body portion 118 and the cord 114, rests upon and is received by the tongue 108 of the female receptacle 102 and passes through the opening in the wall 104. Accordingly, the open ended cavity 106 receives the body portion 118 of the male plug assembly 112, with the collar 120 resting upon and supported by the tongue 108. With the cords 100, 114 being oblique with respect to the engagement of the prongs 116 and slots 110, and with the wall 104 providing secure engagement with the body portion 118 of the male plug 112, a mechanically secure electrical engagement may be attained between the male plug assembly 112 and the female receptacle 102.

It will also be appreciated that the male plug assembly 112 may be employed as an integral unit in replacement of the combination of the conventional plug 22 and angled plug adapters 20 as illustrated in FIG. 1. Such angling of the cord from the flat plug achieves the benefits recited above with respect to the embodiment of FIG. 1.

With reference now to FIGS. 16 and 17, it can be seen that a plug assembly according to another embodiment of the invention is designated generally by the numeral 130. The plug assembly 130 consists of a top plate 132 positioned over a bottom plate 134, with a body portion 136 interposed therebetween. According to the preferred embodiment of the invention, the top plate 132 is smaller than the bottom plate 134, and the body portion 136 is characterized by concave sides. This configuration allows for ease of gripping or engaging the plug assembly 130, which is also facilitated by its generally elliptical shape.

A cord collar 138 extends from a "corner" of body portion 136 about midway between the major and minor axes of the generally elliptical assembly. An electrical cord 140 extends from the cord collar 138, as illustrated. Of course, electrical prongs 142 extend out of a bottom plate 134 and are in electrical communication with the cord 140.

With the plug assembly 130 being generally elliptical, having a top plate which is smaller than the bottom plate, and with an elliptical configuration and a body portion having concave sides, the plug assembly is easily gripped by a user. Moreover, with cord collar 138 extending from a "corner" of the assembly, and with the cord collar being parallel, rather than perpendicular, to the top and bottom plates 132, 134, the plug is easily used. This ease of use is further facilitated by the fact that the cord 138 is at an angle, such as 45 degrees, with respect to the electric prongs 142 with which it interconnects. The resultant plug assembly 130 is easier, safer, and faster to use. Gripping of plug assembly 130 is more stable and ergonomic than in the prior art. Moreover, more fingers may be used to engage the plug assembly, allowing for ease of alignment of the electric prongs 142 with the receptacle of the outlet.

Figure 18:
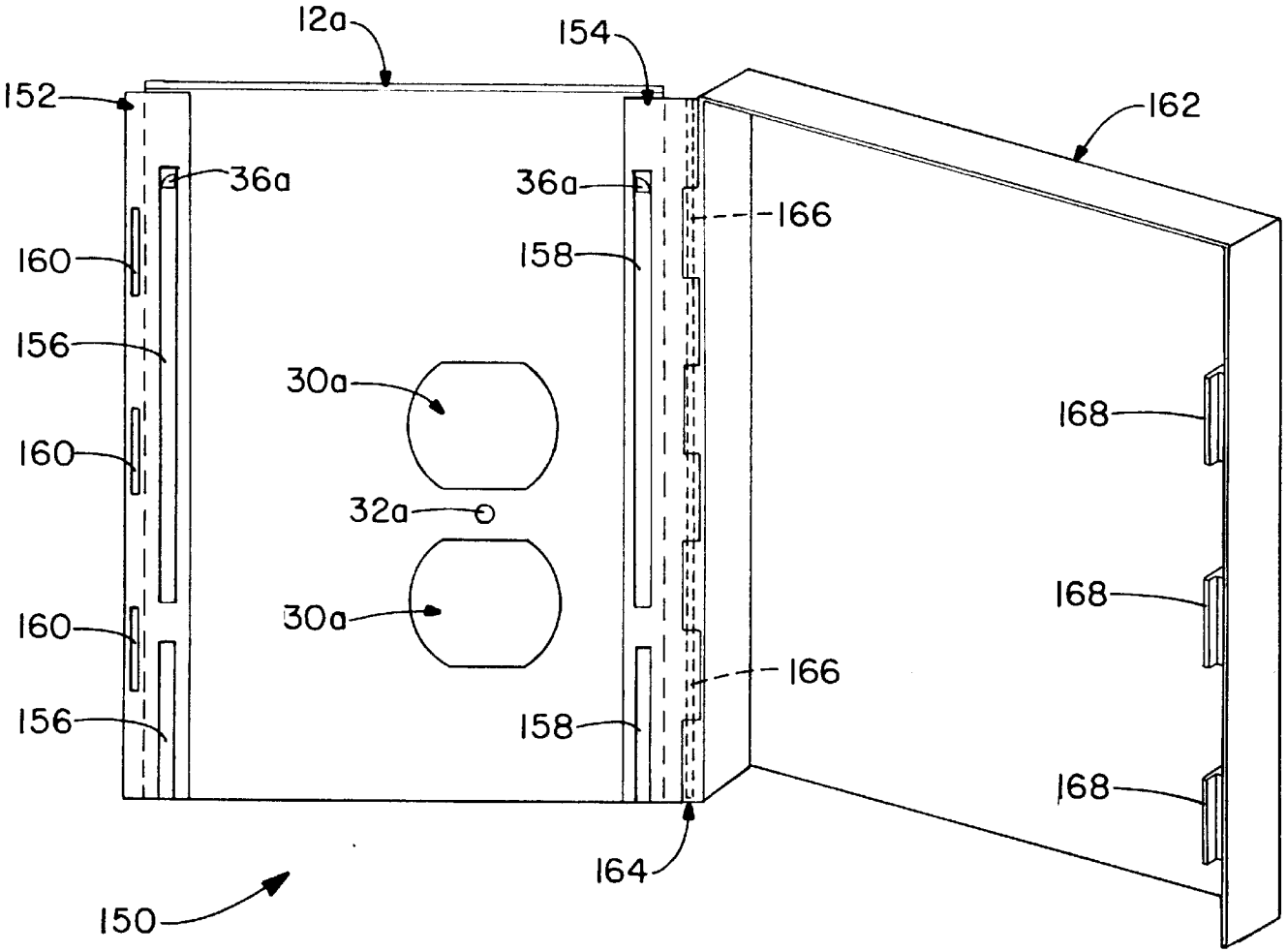
FIG. 18 is a base plate and cover assembly according to another embodiment of the invention, wherein the cover plate and box are hingedly interconnected.

With reference now to FIG. 18, yet another embodiment of the base plate and cover assembly according to the invention can be seen as designated generally by the numeral 150. In this embodiment, the base plate 12*a* is substantially identical to the base plate 12 as shown in FIG. 3. As with the previously described cover plate, the base plate 12*a* has apertures 30*a* for receiving a wall socket, along with an aperture 32*a* for receiving a screw to secure the base plate 12*a* to the wall socket. Stops 36*a* are also present. Those skilled in the art will readily appreciate that the structure just described is the same as the structure of the base plate 12. Modification is made by attaching to opposite sides of the base plate 12*a*, a latch rail 152 and a hinge rail 154. Each of the rails 152, 154 is fitted over an opposite longitudinal edge of the base plate 12*a*. The rails 152, 154 effectively sandwich the opposite edges of the base plate 12*a* therebetween. Accordingly, it will be appreciated that the rails 152, 154 are generally U-shaped in cross-sectional configuration. The rails 152, 154 have respective discontinuous slots 156, 158 extending longitudinally therein. The slots 156, 158 are adapted to receive the stops 36*a* of base plate 12*a*. The stops 36*a* serve to hold the rails 152, 154 in place along the respective edges of the base plate 12*a*. The secured engagement is also obtained by a frictional fit achieved when rails 152, 154 sandwich the edges of base plate 12*a*.

A cover box 162 is hingedly secured to the base plate 12*a* by an appropriate hinge 164 and hinge pin 166. I will be appreciated that mating portions of the hinge 164 are retained on an edge of the cover box 162 and the hinge rail 154. The cover box 162 can be easily secured to or removed from the base plate 12*a* by means of the hinge pin 166.

Latch rail 152 is provided with a plurality of latch slots 160. The latch slots 160 are adapted to engage the tabs 168 extending from the edge of the cover box 162 opposite the edge containing the hinge 164. The tabs 168 make a frictional fit engagement with the latch slots 160. Accordingly, the cover box 162 may be closed upon and conceal the electrical outlet and associated plug by rotating the cover box 162 about the hinge 164 until the locking tabs 168 make frictional locking engagement with the latch slot 160.

Figure 19:
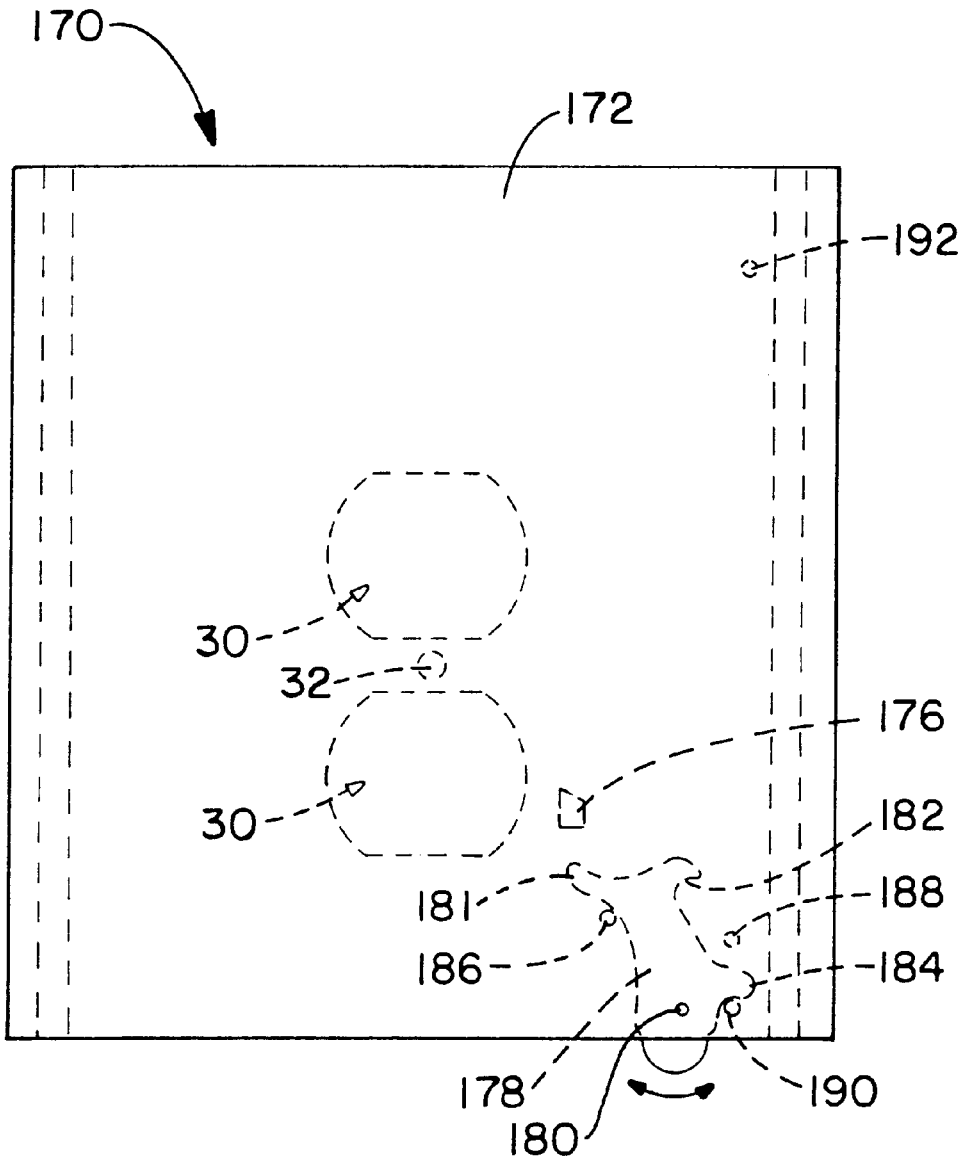
FIG. 19 is a front elevational view of a wall plate and cover assembly according to another embodiment of the invention.
Figure 20:
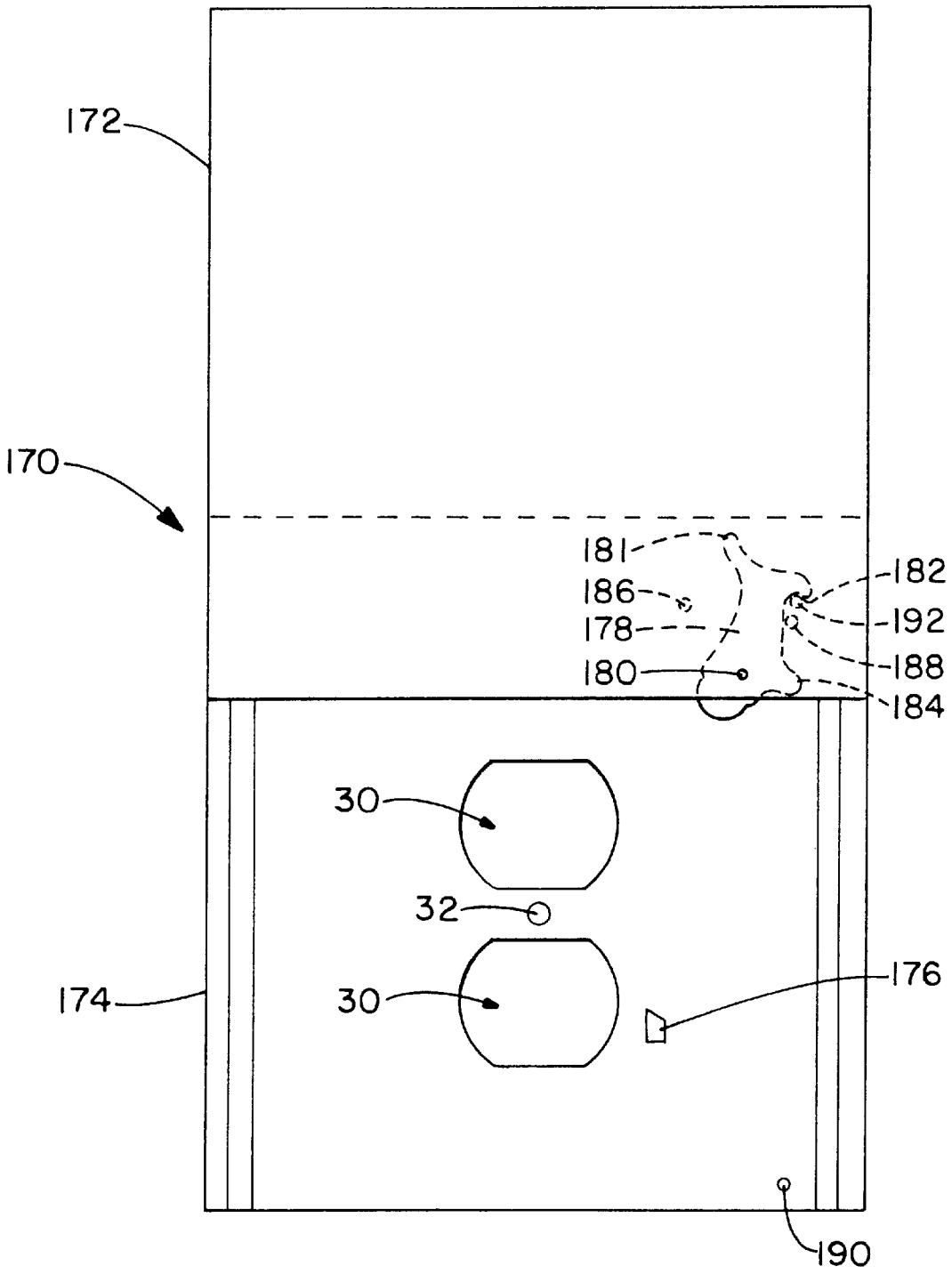
FIG. 20 is a front elevational view of the wall plate and cover assembly of FIG. 19, wherein the cover is in an open position.

With reference now to FIGS. 19 and 20, yet another embodiment of the wall plate and cover assembly can be seen as designated by the numeral 170. This embodiment includes a locking mechanism to limit access to the wall outlet and to deny such access to children. Here, a cover 172 is slidably received on base plate 174 as described earlier herein. The base plate 174 includes a stop 176 extending therefrom and adapted for engagement with a cam lock 178 secured to the cover 172 as by a pivot pin 180. The cam lock 178 has a lobe 181 and a catch 182 at an upper end thereof, and a lobe 184 near a lower end, as shown. Pins 186, 188 are connected to and extend inwardly from the cover 172 toward the base plate 170. Pins 190, 192 are connected to and extend outwardly from the base plate 174 toward the cover 172.

As illustrated in FIG. 19, if the cover 172 is slid upwardly on the base plate 174, the lobe 181 engages the stop 176 and prevents any movement that would expose the outlet apertures 30. However, an adult with knowledge of the operation of the cam lock 178 may manipulate the cam lock in such a way as to make ready exposure of the outlet. When the cover 172 is raised slightly, the cam lock 178 is free to pivot clockwise about the pivot pin 180 such that the lobe 184 clears pin 190 and lobe 181 clears the stop 176. The cover 172 is now free to be raised and, as it is raised, should the cam member 178 tend to rotate further in the clockwise direction, the pin 188 will limit such further rotation. When the cover is at the topmost position, the catch 182 may be rotated to engage the pin 192 to maintain the cover in the top position as shown in FIG. 20.

To lower the cover, the cam 178 is rotated counterclockwise to disengage catch 182 from pin 192. The cover is free to move downwardly. The cam may rest against the pin 186 during descent. When the lobe 181 reaches the stop 176, it is deflected. When the lobe 184 reaches the pin 190, the cam lock 178 is forced to pivot to engagement with the pin 186. The cam lock is now in the original position to lock the cover 172 from being raised.

It should thus be appreciated that a cover box may be slidingly or hingedly secured to a wall base plate in accordance with the concept of the present invention.

Thus it can be seen that the objects of the invention have been satisfied by the structure presented above. While in accordance with the patent statutes only the best mode and preferred embodiment of the invention have been presented and described in detail, the invention is not limited thereto or thereby. Accordingly, for an appreciation of the true scope and breadth of the invention reference should be made to the following claims.

What is claimed is:

1. An outlet cover assembly, comprising:

a base plate receiving and maintaining an electrical outlet;

a cover plate received by said base plate, said cover plate selectively covering and exposing said base plate, said base plate having a pair of tracks, one on each of opposite sides thereof; and wherein said cover plate is slidingly received by said tracks, and a lock is interposed between said base plate and said cover plate to limit access to said outlet, said lock comprising a pivoting cam connected to said cover plate, a stop connected to said base plate in juxtaposition to said cam, a first pin extending from said base plate and a second pin extending from said cover plate, said cam resting between said first and second pins when said cover plate is closed over said base plate.

2. The outlet cover assembly according to claim 1, wherein said lock further comprises a third pin extending from said base plate, said cam having a latch engaging said third pin for holding said cover plate above said base plate to expose said outlet.

3. The outlet cover assembly according to claim 1, wherein said base plate has apertures for said electrical outlet, said apertures being offset toward one side of said base plate to accomodate passage of cords along another side thereof.

4. The outlet cover assembly according to claim 3, wherein each of said cords is an electrical cord having a plug at an end thereof, said plug having prongs extending therefrom, said prongs being in a line with each other and said cord connecting to said plug obliquely to said line.

5. The outlet cover assembly according to claim 3, further comprising an adapter received by said electrical outlet, said adapter having male prongs engaging said electrical outlet and female slots for receiving a plug of an electrical cord, said female slots being angled toward said other side of said base plate.

6. An outlet cover assembly, comprising:

a base plate receiving and maintaining an electrical outlet;

a cover plate received by said base plate, said cover plate selectively covering and exposing said base plate, said base plate having a pair of tracks, one on each of opposite sides thereof; and wherein said base plate has apertures for said electrical outlet, said apertures being offset toward one side of said base plate to accomodate passage of cords along another side thereof, and wherein each of said cords is an electrical cord having a plug at an end thereof, said plug having prongs extending therefrom, said prongs being in a line with each other and said cord connecting to said plug obliquely to said line.

7. An outlet cover assembly, comprising:

a base plate receiving and maintaining an electrical outlet;

a cover plate received by said base plate, said cover plate selectively covering and exposing said base plate, said base plate having a pair of tracks, one on each of opposite sides thereof; and wherein said base plate has apertures for said electrical outlet, said apertures being offset toward one side of said base plate to accomodate passage of cords along another side thereof, and further comprising an adapter received by the electrical outlet, said adapter having male prongs engaging the outlet and female slots for receiving a plug of an electrical cord, said female slots being angled toward said other side of said base plate.

* * * * *